US009429047B2

(12) United States Patent
Geist et al.

(10) Patent No.: US 9,429,047 B2
(45) Date of Patent: Aug. 30, 2016

(54) TECHNIQUES FOR DESIGNING CUSTOM CONTOURED ROCKER ARM PADS AND CUSTOM CONTOURED CAMSHAFT LOBES

(71) Applicants: Bruce Geist, Sterling Heights, MI (US); Scott K Fisher, Northville, MI (US); William F Resh, East Lansing, MI (US); Mark S Hannon, South Lyon, MI (US); Christopher L Allmond, Rochester Hills, MI (US)

(72) Inventors: Bruce Geist, Sterling Heights, MI (US); Scott K Fisher, Northville, MI (US); William F Resh, East Lansing, MI (US); Mark S Hannon, South Lyon, MI (US); Christopher L Allmond, Rochester Hills, MI (US)

(73) Assignee: FCA US LLC, Auburn Hills, MI (US)

( * ) Notice: Subject to any disclaimer, the term of this patent is extended or adjusted under 35 U.S.C. 154(b) by 233 days.

(21) Appl. No.: 14/076,480

(22) Filed: Nov. 11, 2013

(65) Prior Publication Data

US 2015/0128887 A1 May 14, 2015

(51) Int. Cl.
*F01L 1/18* (2006.01)

(52) U.S. Cl.
CPC . *F01L 1/18* (2013.01); *F01L 1/181* (2013.01)

(58) Field of Classification Search
CPC ..... F01L 1/181
See application file for complete search history.

(56) References Cited

U.S. PATENT DOCUMENTS 6,491,012 B2 12/2002 Pryba et al.
7,136,789 B2 11/2006 Mosier et al.
2011/0067660 A1* 3/2011 Orban ..... F01L 1/181 123/90.39

OTHER PUBLICATIONS

Geist, B. et al., "Analysis and Customization of Rocker Arm Joint Sliding Velocity," Proceedings of ICES2008 2008 Spring Technical Conference of the ASME Internal Combustion Engine Division, Apr. 27-30, 2008, Chicago, Illinois, USA, pp. 1-9.

Geist, B. et al., "Assessing the Propensity for Valve Train Tick Noise," SAE International J. Engines, vol. 6, Issue 1, doi:10.4271/2013-01-1737 saeeng.saejournals.org, Apr. 8, 2013, 10 pages.

* cited by examiner

*Primary Examiner* — Thomas Denion
*Assistant Examiner* — Daniel Bernstein
(74) *Attorney, Agent, or Firm* — Ralph E. Smith

(57) ABSTRACT

A computer-implemented method can include receiving a contact point path between a rocker arm pad and a valve tip. The method can include adjusting the contact point path to obtain a modified contact point path that satisfies a design objective of decreased valve tip wear or decreased valve tick. The method can include determining and outputting a custom contour for the rocker arm pad and the camshaft lobe based on the modified contact point path. The custom contoured camshaft lobe can companion with the custom contoured rocker arm pad to produce the modified contact point path for the specified design objective.

13 Claims, 9 Drawing Sheets

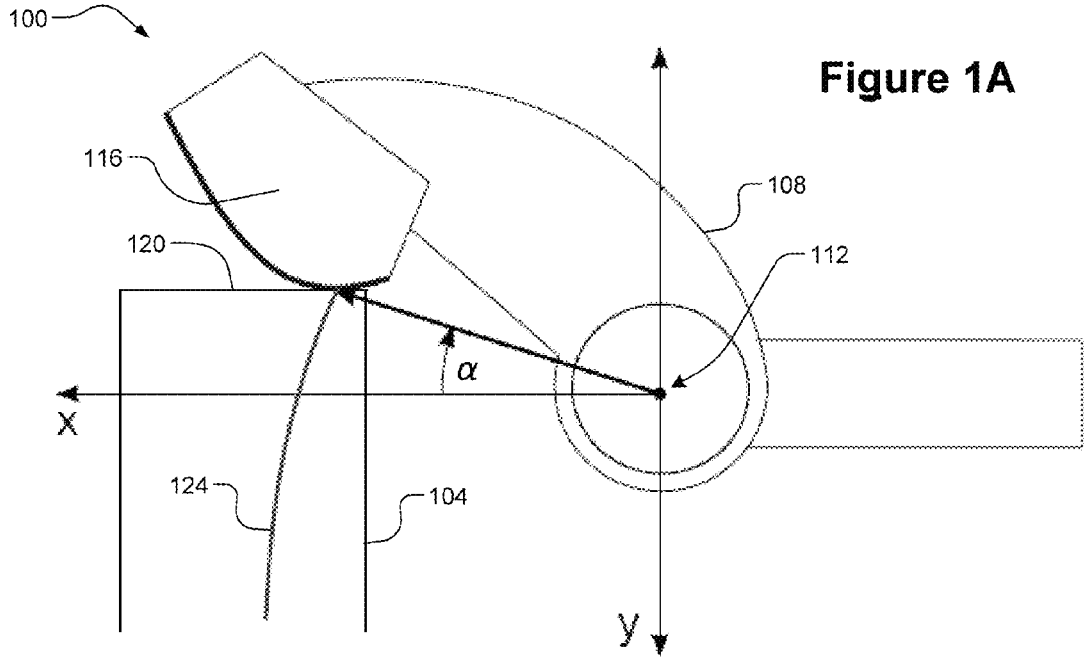
Figure 1A
Figure 1B
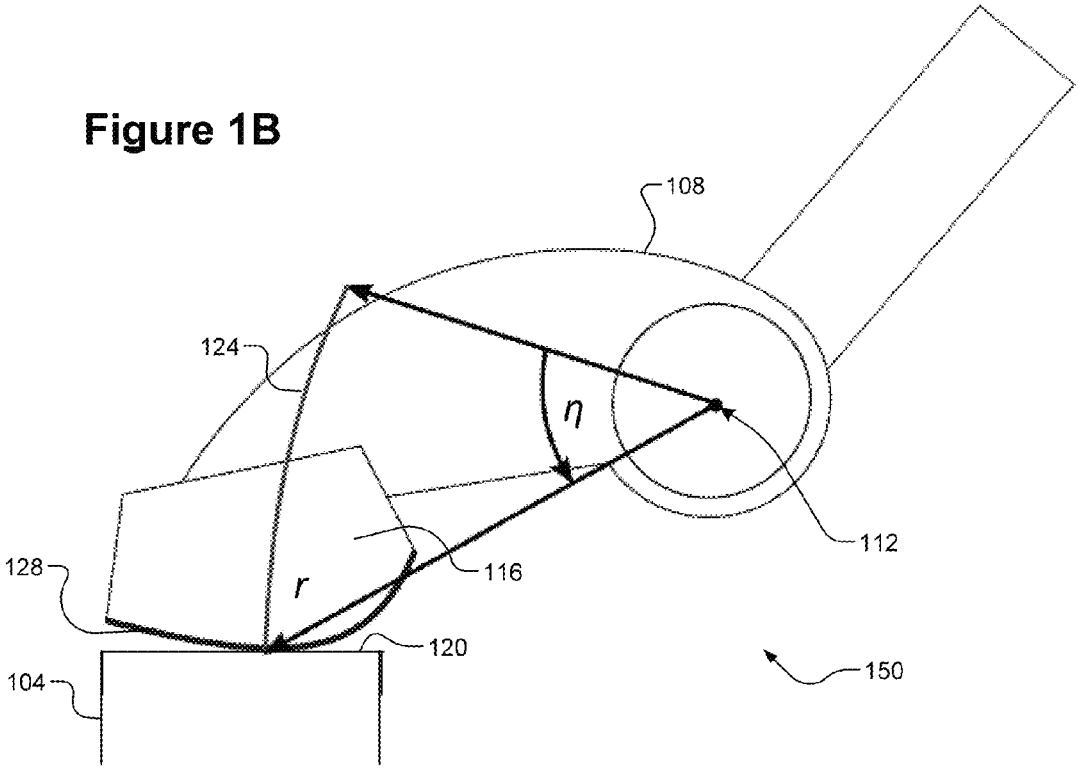

600

700

750

TECHNIQUES FOR DESIGNING CUSTOM CONTOURED ROCKER ARM PADS AND CUSTOM CONTOURED CAMSHAFT LOBES

FIELD

The present disclosure relates generally to internal combustion engines and, more particularly, to techniques for designing custom contoured rocker arm pads and custom contoured camshaft lobes.

BACKGROUND

Internal combustion engines combust an air/fuel mixture within a plurality of cylinders to generate drive torque. Intake and exhaust valves of the cylinders can be controlled to draw in air and expel exhaust gas, respectively. These valves can be actuated by pads of respective rocker arms, and the rocker arms can be actuated by respective followers or a respective followers and pushrods. The followers or followers/pushrods can be actuated by respective lobes of a camshaft.

The rocker arm pads and the camshaft lobes can have specific curvatures. The curvature of a specific camshaft lobe can affect how its respective rocker arm is actuated. This rocker arm actuation and the interface between the rocker arm pad and the valve tip together can determine how a valve will accelerate as a function of cam lobe rotation. Similarly, the curvature of the respective rocker arm pad can also affect how its respective valve is actuated.

SUMMARY

In one form, a method is provided in accordance with the teachings of the present disclosure. The method can include receiving, at a computing device having one or more processors, parameters for a rocker arm of an engine and parameters for a valve of the engine, the rocker arm having a pad that is operable to engage a tip of the valve. The method can include adjusting, at the computing device, a contact point path to obtain a modified contact point path that satisfies a design objective of decreased valve tip wear or decreased valve tick, the contact point path and modified contact point path each defining a plurality of contact points between the rocker arm pad and the valve tip at various rotation angles of the rocker arm. The method can include determining, at the computing device, a custom contour for the rocker arm pad based on the rocker arm parameters, the valve parameters, and the modified contact point path. The method can also include outputting, at the computing device, the custom contour for the rocker arm pad.

In another form, a method is provided in accordance with the teachings of the present disclosure. The method can include receiving, at a computing device including one or more processors, a contact point path defining a plurality of contact points between a pad of a rocker arm of an engine and a tip of a valve of the engine at various rotation angles of the rocker arm, the engine including a camshaft having a lobe operable to actuate the rocker arm via a follower or follower/pushrod, the valve having a stem and a guide. The method can include calculating, at the computing device, one or more metrics based on the contact point path, the one or more metrics including at least one of (i) a valve tip wear metric and (ii) a stem-to-guide collision energy of the valve. The method can include outputting, at the computing device, the one or more metrics. The method can include receiving, at the computing device, an adjustment to the contact point path from a user to obtain a modified contact point path that satisfies a design objective of decreased valve tip wear or decreased valve tick, the modified contact point path causing at least one of the one or more metrics to decrease below a respective predetermined threshold. The method can include determining, at the computing device, custom contours for the rocker arm pad and the camshaft lobe based on the modified contact point path. The method can also include outputting, at the computing device, the custom contours for the rocker arm pad and the camshaft lobe.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

BRIEF DESCRIPTION OF THE DRAWINGS

FIGS. 1A-1B are example schematics of a valve and a rocker arm according to the principles of the present disclosure;

DESCRIPTION

Figure 2:
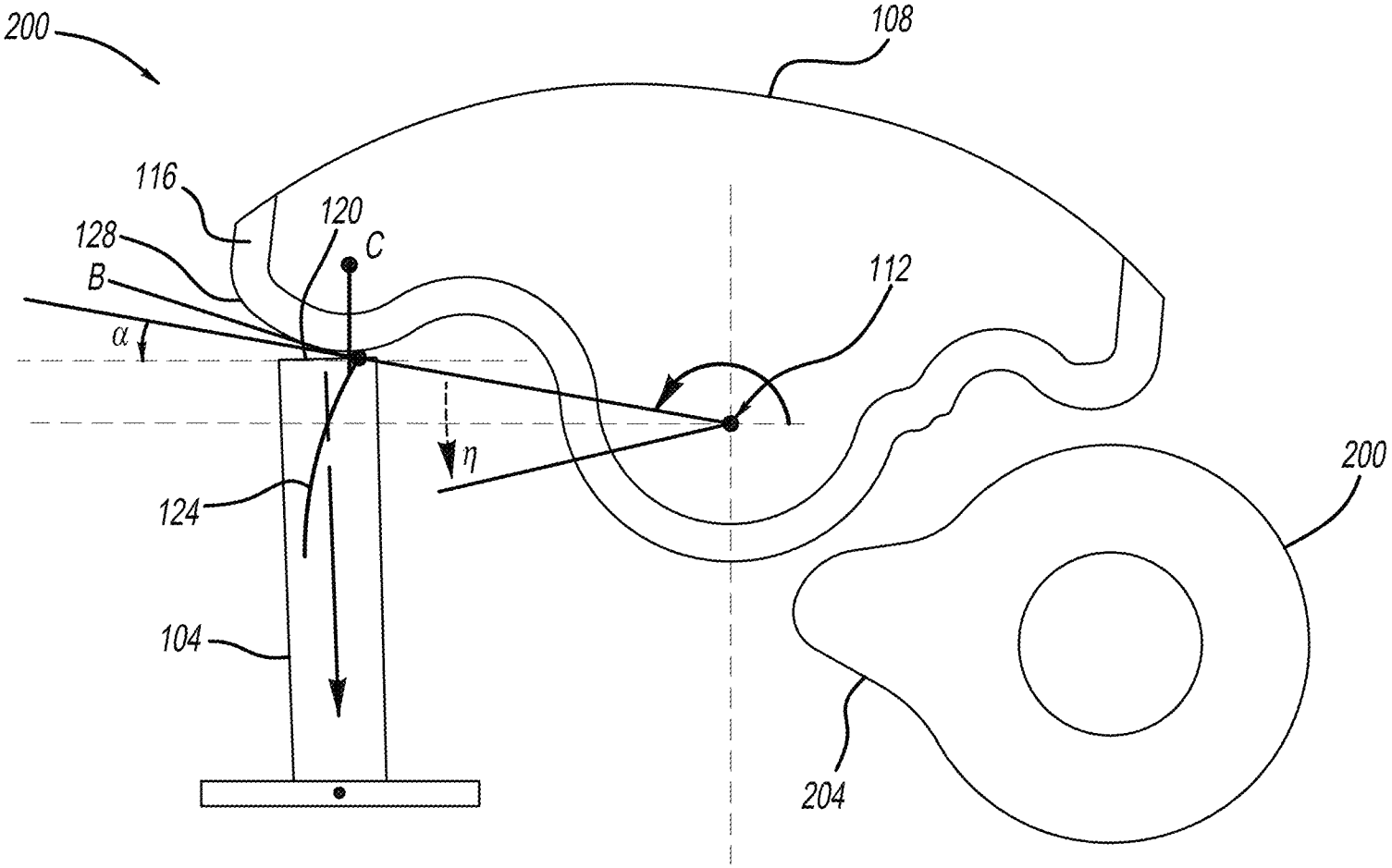
FIG. 2 is an example schematic of a valve, a rocker arm, and a camshaft according to the principles of the present disclosure.

As previously mentioned, engine valves can be actuated by pads of respective rocker arms. More specifically, each rocker arm can rotate about a pivot, and its rocker arm pad can exert a downward force on a tip of the respective valve to actuate the valve. The curvature of each rocker arm pad can affect how the force is applied to the respective valve tip. Therefore, the curvature of each rocker arm pad can affect wear of the valve tip and can cause the respective valve stem to collide with its guide, which is also known as valve tick. The rocker arms can be actuated by respective followers or respective followers and pushrods. The followers or followers/pushrods can in turn be actuated by respective lobes of a camshaft. Thus, the curvature of each camshaft lobe can also affect how the rocker arm is actuated. Therefore, the curvature of each camshaft lobe can also affect valve tip wear and/or valve tick.

Accordingly, techniques are presented for designing custom contoured rocker arm pads and custom contoured camshaft lobes. The term "contour" as used herein can refer to the curvature or shape of a surface of the rocker arm pads and camshaft lobes. The techniques can include receiving parameters for a rocker arm and parameters for a valve. The techniques can also include receiving a contact point path and receiving adjustments to the contact point path, e.g., by a user, to obtain a modified contact point path that satisfies a design objective. For example, the contact point path may be a default contact point path corresponding to a rocker arm pad and/or a camshaft lobe having a custom curvature.

The design objective may be decreasing the projected wear of the valve tip by minimizing the peak value of a wear metric. For example, the wear metric may be a product of contact stress/pressure multiplied by magnitude of a sliding velocity between the rocker arm pad and the valve tip at each point of contact. Both the contact stress and the sliding velocity between the rocker arm pad and the valve tip can be controlled by proper specification of a contact point path, i.e., the trajectory of the contact point during valve motion. One wear-reduction strategy may be a small curvature (a flatter rocker arm pad) when a force is high (high load), and a larger curvature (a sharper rocker arm pad) when the force is low (low load).

Alternatively, the design objective may be decreasing valve tick. Decreased valve tick can be accomplished by designing a rocker arm pad surface that calibrates moments that act on the valve so that the energy of collisions of valve to guide (or valve stem to valve guide) is decreased. This collision energy can also be controlled by specification of the contact point path. One anti-tick strategy is to produce an offset moment for the valve tip that opposes its friction moment, thereby decreasing or eliminating collision between the valve and its guide.

Further, the techniques can also determine and output a custom contour for a camshaft lobe based on the custom contour for the rocker arm pad. This custom contoured camshaft lobe, in conjunction with the custom contoured rocker arm pad, can provide the desired contact point path, and thus can achieve the desired design objective. In other words, the custom contoured camshaft lobe can provide the desired actuation of the rocker arm via a follower or follower/pushrod. In some implementations, the techniques may generate the custom contour for the camshaft lobe without generating the custom contour for the rocker arm pad.

The custom contoured camshaft lobe can either (i) further decrease valve tip wear or valve tick or (ii) more efficiently decrease valve tip wear or valve tick in conjunction with the custom contoured rocker arm pad. In one example of improved efficiency, the custom contoured camshaft lobe could be designed or adjusted to overcome manufacturing constraints of the custom contoured rocker arm pad, e.g., tooling that cannot manufacture a specific curvature for the rocker arm pad.

Referring now to FIG. 1A, a first example schematic 100 of a valve 104 and a rocker arm 108 is illustrated. It should be appreciated that while an overhead camshaft configuration is illustrated and discussed herein, the techniques can be similarly applied to other valve actuation configurations, e.g., pushrod configurations. The valve 104 can be any suitable valve of an engine, such as an intake valve or an exhaust valve. The rocker arm 108 can actuate the valve 104 by applying a downward force on the valve 104 by rotating about a pivot point 112. The rocker arm 108 can be driven by a camshaft (not shown), which is discussed in further detail below.

The rocker arm 108 includes a rocker arm pad 116 that contacts a tip 120 of the valve 104. A contact point path 124 defines various contact points of the rocker arm pad 116 along the valve tip 120. This schematic 100 can also be referred to as a zero-lift state of the valve 104 because the rocker arm 108 is just beginning to actuate the valve 104. Angle $\alpha$ represents an initial angle between a plane of the valve tip 120 and a plane connecting an initial contact point, i.e., at zero-lift, and the rocker arm pivot point 112.

Referring now to FIG. 1B, a second example schematic 150 of the valve 104 and the rocker arm 108 is illustrated. This schematic 150 can also be referred to as a lift-state of the valve 104 because the rocker arm 108 has actuated the valve 104. For example, the valve 104 may be actuated to its maximum lift. As shown, the rocker arm 108 has actuated the valve 104 along the contact point path 124. More specifically, the rocker arm pad 116 has applied a downward force to the valve tip 120 at the various contact points defined by the contact point path 124.

Radius r represents a radial distance from the rocker arm pivot point 112 to a specific contact point on the valve tip 120. Angle $\eta$ represents an angular coordinate of the specific contact point. These parameters ($\alpha$, r, $\eta$) can be used to calculate a curvature or surface 128 of the rocker arm pad 116 at a specific contact point of the valve tip 120. For example, the curvature 128 can be calculated as follows:

$$\kappa_2 = \frac{1}{\left(\frac{dr}{dn}\right)\cos(\eta - \alpha)},$$

where $\kappa_2$ is the curvature 128 of the rocker arm pad 116.

Referring now to FIG. 2, a third example schematic 200 of the valve 104, the rocker arm 108, and a camshaft 200 is illustrated. The camshaft 200 can have a camshaft lobe 204 that indirectly engages the rocker arm 108. Rather, the camshaft lobe 204 can engage a follower or a follower/pushrod, which can in turn engage the rocker arm 108.

When the design objective is decreased valve tip wear, a valve tip wear metric can be calculated. It should be appreciated, however, that one or more metrics can be calculated during specification/adjustment of the contact point path, which is described in greater detail below. This valve tip wear metric can be calculated based on a product of (i) a sliding velocity ($\upsilon^{(12)}$) (example calculation set forth below) between the rocker arm pad 116 and the valve tip 120 at each contact point along the contact point path 124 and (ii) a contact stress between the rocker arm pad 116 and the valve tip 120 at each point along the contact point path 124. The sliding velocity $\upsilon^{(12)}$ and the contact stress can also be based on various parameters of the rocker arm pad 116 and the valve tip 120.

These rocker arm parameters can include, but are not limited to, (i) material parameters of the rocker arm pad 116 (elastic modulus, Poisson's ratio, etc.), (ii) the initial point of contact by the rocker arm pad 116 on the surface of the valve tip 120 and a distance (radius) between the initial contact point and the rocker arm pivot point 112, and (iii) average force (or pressure) applied by the rocker arm pad 116 to the valve tip 120 during a single valve event. This average force may be predetermined based on dynamometer data for the engine.

In some implementations, the average force may be a weighted average of force at three different engine loads: (i) idle, (ii) low-load, e.g., 2000 RPM, and (iii) high-load, e.g., 5500 RPM. The weighting can be based on an amount of time the engine typically operates at that specific load. For example, the majority of the engine's life may be spent operating at low-load, and thus the force corresponding to low load may be given a larger weight. The contact stress can be determined based on this average force and any other suitable parameters.

The valve parameters can include, but are not limited to, (i) material parameters of the valve tip 120 (elastic modulus, Poisson's ratio, etc.), (ii) a maximum lift of the valve 104, (iii) dimensions of the valve 120 (stem diameter, guide diameter, guide length, unguided cold length, etc.), (iv) the initial angle $\alpha$ between the plane of the valve tip 120 and the plane connecting the initial contact point and the rocker arm pivot point 112, and (v) a friction coefficient for the frictional force between the rocker arm pad 116 and the valve tip 120.

For example, the sliding velocity $\upsilon^{(12)}$ at a specific contact point along the contact point path 124 may be calculated as follows:

$$\upsilon^{(12)}=r\omega\sin(\eta-\alpha),$$

where $\upsilon^{(12)}$ represents the sliding velocity, r represents the radial distance from the rocker arm pivot point 112 to the specific contact point, $\eta$ represents the angular coordinate of the specific contact point, $\omega$ represents a change rate of change of $\eta$, and $\alpha$ represents the initial angle between the plane of the valve tip 120 and the plane connecting the initial contact point and the rocker arm pivot point 112.

Based on the above, the valve tip wear metric can be calculated at each contact point along the contact point path 124. In some implementations, an overall valve tip wear metric can be calculated based on the valve tip wear metric at each contact point along the contract point path, e.g., an average valve tip wear metric. A change in the contact point path 124 can cause a decrease in the valve tip wear metric(s). In one implementation, the contact point path 124 may be adjusted until the valve tip wear metric(s) decrease(s) below a predetermined wear threshold. For example only, the predetermined wear threshold may correspond to a maximum valve tip wear metric that causes unacceptable and/or uneven valve tip wear.

Figure 3:
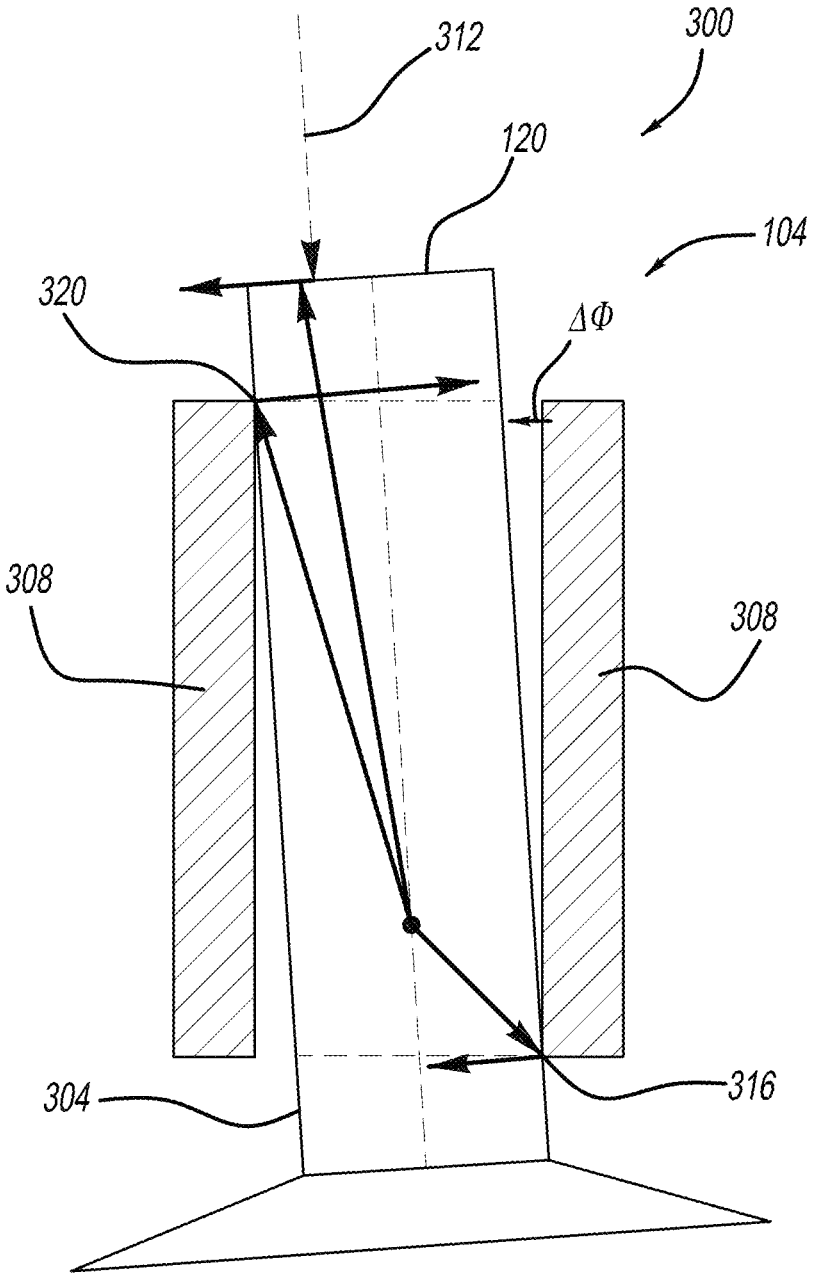
FIG. 3 is an example schematic of a valve according to the principles of the present disclosure.

Referring now to FIG. 3, a fourth example schematic 300 of the valve 104 is illustrated. The valve 104 can include the valve tip 120, a valve stem 304, and a valve guide 308. When the valve tip 120 is actuated by the rocker arm pad 116, a force ($F_{vt}$) is applied to the valve 104 at a specific contact point 316. The force $F_{vt}$ can be divided into downward and lateral components depending on the specific contact point where the force $F_{vt}$ is applied on the valve tip 120. If the force 312 is applied at a center of the valve tip 120, the force $F_{vt}$ may include only a downward component. If the force $F_{vt}$ is applied at a non-center location of the valve tip 120, however, the force $F_{vt}$ may include both a downward component and a lateral component.

This lateral component of the force $F_{vt}$ may cause the valve stem 304 to collide with the valve guide 308. More specifically, the valve stem 304 can pivot at a bottom corner of the valve guide 308. This pivoting can occur at partial-lift and/or maximum lift reorientation events. FIG. 3 illustrates the valve stem 304 pivoting at a bottom-right corner 316 of the valve guide 308 during a partial-lift reorientation event. In addition to colliding with the valve guide 308 at the bottom-right corner 316, the valve stem 304 can also collide with a top-left corner 320 of the valve guide 308. These collisions can produce audible noise that is known as valve tick. Further, in some cases the valve stem 304 may deflect off the valve guide 308 and again collide with the valve guide 308 at opposite corners.

To decrease or eliminate valve tick, moments that act on the valve 104 can be calibrated so that the kinetic energy of collisions of valve-to-guide (or valve stem 304 to valve guide 308) is decreased. This collision energy, or "smack energy," can also be controlled by specification of the contact point path 124. One anti-tick strategy is to produce an offset moment for the valve tip 120 that opposes its friction moment, thereby decreasing or eliminating collision between the valve stem 304 and its valve guide 308. An angular slack ($\Delta\phi$) represents how much room there is in the valve guide 308 for the valve stem 304 to rotate about the bottom of the valve guide 308. The angular slack $\Delta\phi$ can be used to determine the smack energy of the valve 104.

In addition to the angular slack $\Delta\phi$, the smack energy of the valve 104 can be calculated based on (i) the angle $\alpha$, which represents the initial angle between the plane of the valve tip 120 and the plane connecting the initial contact point and the rocker arm pivot point 112, and (ii) a moment (T) of the valve tip 120. More specifically, the moment T can be calculated just after the sliding velocity $\upsilon^{(12)}$ changes signs. The sliding velocity $\upsilon^{(12)}$ can change signs at $\eta=\alpha$, where $\eta$ represents the angular coordinate of the contact point 316, and at maximum lift (where $\eta$ changes sign).

This calculation of the moment T can also be based on (i) the distance (D) from the valve tip 120 to the bottom of the valve guide 308, (ii) the distance (d) from the center of the valve stem 304 to the contact point 316, (iii) the sign of the sliding velocity $\upsilon^{(12)}$, and the force $F_{vt}$ exerted by the rocker arm pad 116 on the valve tip 120 at the contact point 316. Further, the calculation of the distance d can be based on (i) a radius ($\sigma$) of the rocker arm pad 116 and (ii) a distance (P) from the rocker arm pivot point 112 to a center of curvature of the rocker arm pad 116.

The smack energy for the valve 104 can then be calculated using the following equation:

$$|T\cdot\Delta\phi|.$$

Specifically, the smack energy can be calculated as shown above for each side-wall (stem-to-guide) collision event. A change in the contact point path 124 can cause a decrease in the smack energy for each collision event. In one implementation, the contact point path 124 may be adjusted until the smack energy for each collision event decreases below a predetermined smack energy threshold. For example only, the predetermined smack energy threshold may correspond to a minimum smack energy that causes audible valve tick.

As previously mentioned, the curvature of the camshaft lobe 204 can affect the movement of the rocker arm 108, which in turn can affect the contact point path 124 between the rocker arm pad 116 and the valve tip 120. More specifically, a rotation angle ($\phi$) of the camshaft 200 can affect the rotation angle $\eta$ of the rocker arm 108. By using the specified contact point path associated with the custom contour of the rocker arm pad 116, the custom contour of the camshaft lobe 204 can be calculated. Further, all other variables of the camshaft lobe 204, such as a camshaft lift profile $l(\phi)$, can be predefined and held as constraints.

In order to calculate the rotation angle $\eta$ for the rocker arm 108 for each rotation angle $\phi$ of the camshaft lobe 204, a dependency between (i) an arc-length distance(s) along a surface of the rocker arm pad 116 as measured from the zero-lift contact point and (ii) the rotation angle $\phi$ can first be determined. This dependency can be referred to as the function $s(\phi)$. When $s(\phi)$ is known, angular displacement, angular velocity, and angular acceleration of the rocker arm 108 as a function of $\phi$ can be determined. Angular velocity ($d\eta/d\phi$) and angular acceleration ($d^2\eta/d^2\phi$) represent the first and second derivatives of the angular displacement ($\eta(\phi)$).

The contact point path 124 can be provided as input and represented as ($\tau(s)$,$r(s)$), where ($\tau$,$r(\tau)$) represent polar coordinates. The following equation can define a y-coordinate ($\Delta y_{max}$) of the a contact point of the valve tip 120 when the valve 104 is at maximum lift:

$$\Delta y_{max}=r_0 \sin(-\alpha)+h_0,$$

where $r_0$ represents the radial distance from the rocker arm pivot point 112 to the initial contact point, and $h_0$ represents the maximum lift displacement of the valve stem 304 within its guide 308. Note that at this maximum valve lift, $l(\phi)-h_0=0$.

Based on the above, the following equation can be obtained, which can be used to uniquely determine the function $s(\phi)$:

$$r(s)+\sin(r(s))=l(\phi)+\Delta y_{max}-h_0.$$

Specifically, $s(\phi)$ can be determined as follows. First, a number N of equally-spaced points over a range of $\phi$ where $l(\phi)$ is non-zero. For example only, N may be approximately 100. Using the following zero-finding routine, for each $\phi$, a value of s can be found:

$$\min_{\varphi} l(\phi_i) + \Delta y_{max} - h_0 - \min_{s} r(s_i)\cdot\sin(\tau(s_i)) = 0,$$

where i is an index from 1 to N (1, 2, . . . , N).

Next, a first interpolating spline can be created that defines the function $s(\phi)=s_i$ for i=1, . . . , N). For example, this spline may be a cubic polynomial that has continuous first and second derivatives. A second interpolating spline $\eta(\phi)$ can then be created that defines $\eta$ as a function of $\phi$ from ($\phi_i$,$\eta(s(\phi_i))$). The first derivative $d\eta/d\phi$ of this interpolating spline $\eta(\phi)$ represents the angular velocity of the rocker arm 108 as a function of $\phi$, and the second derivative $d^2\eta/d^2\phi$ of this interpolating spline $\eta(\phi)$ represents the angular acceleration of the rocker arm 108 as a function of $\phi$.

Utilizing $s(\phi)$, $\eta(\phi)$, $d\eta/d\phi$, and $d^2\eta/d^2\phi$, all valve train kinematics and a custom contour of the camshaft lobe 204 that companions with the custom contour of the rocker arm pad 116 can be calculated. Specifically, the kinematics analysis can then proceed as in a traditional valve train with a cylindrical rocker arm pad, but using these customized parameters that are based on the custom contour for the rocker arm pad 116 instead. The custom contour for the camshaft lobe 204, in conjunction with the custom contour for the rocker arm pad 116, can provide the specified contact point path 124 for the particular design objective.

Figure 4:
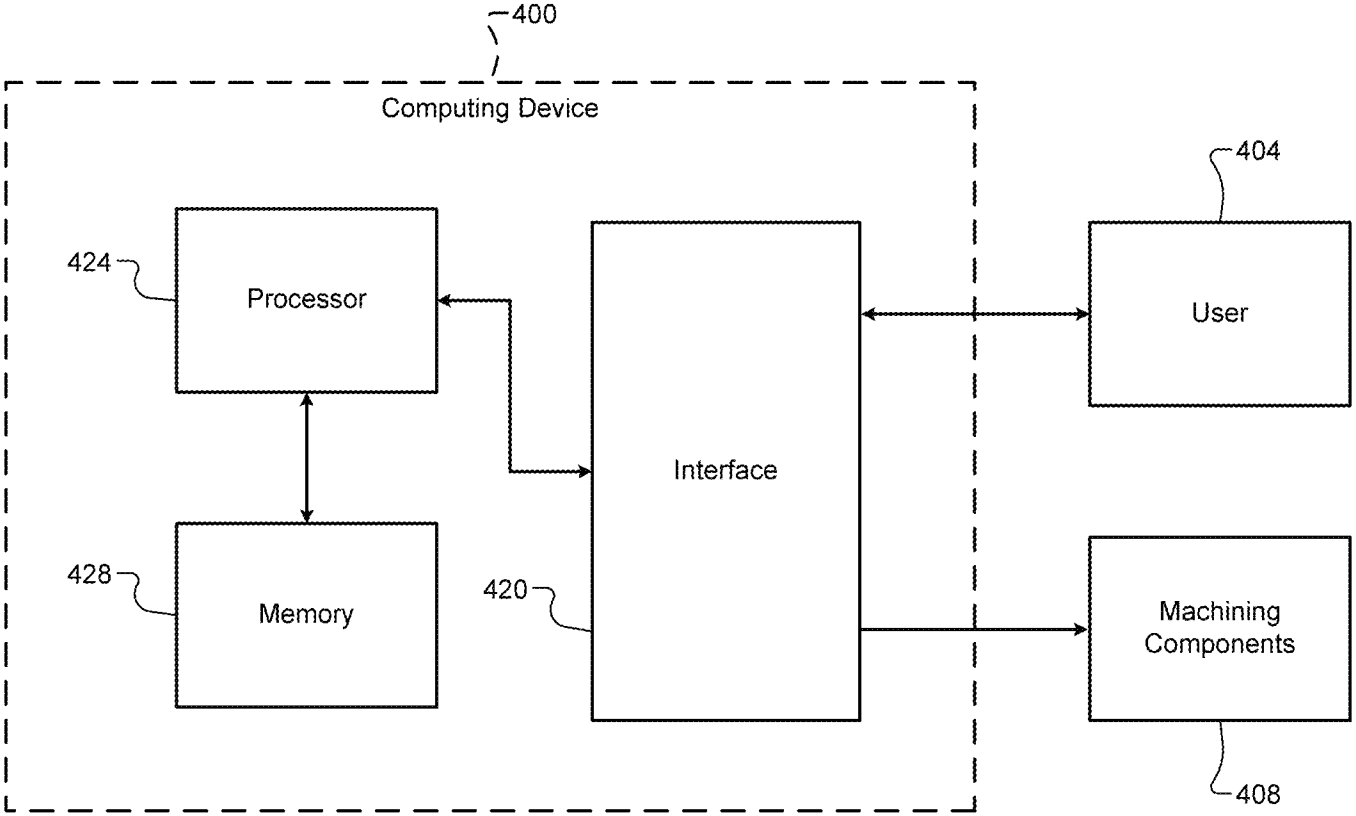
FIG. 4 is an example functional block diagram of a computing device according to the principles of the present disclosure.

Referring now to FIG. 4, an example computing device 400 configured to execute the design techniques of the present disclosure is illustrated. The computing device 400 can be operated by a user 404, e.g., a design engineer. Specifically, the user 404 can provide design input to and can receive custom contour output from the computing device 400. The custom contour output could also be provided to machining components 408 by the computing device 400. The machining components 408 could utilize the custom contour output to machine the custom contoured rocker arm pad and the custom contoured camshaft lobe. For example only, the machining components 408 may be computer numerical control (CNC) machining components.

The computing device 400 can be any suitable computing device (a desktop computer, a laptop computer, etc.) configured to execute the design techniques of the present disclosure. The computing device 400 can include an interface 420, a processor 424, and a memory 428. The computing device 400 can also include other suitable components, such as a transceiver or other device for communication via a network. It should be appreciated that the term "processor" as used herein can refer to both a single processor and two or more processors operating in a parallel or distributed architecture. The memory 428 can be any suitable storage medium (flash, hard disk, etc.) configured to store information at the computing device 400 (rocker arm parameters, valve parameters, contact point path(s), custom curvature(s), etc.).

The interface 420 can be configured to receive input from the user 404. The input can include the various rocker arm parameters, valve parameters, and other parameters. In some implementations, the input can include the contact point path 124 between the rocker arm pad 116 and the valve tip 120. The contact point path 124, however, can also initially be predefined, e.g., a default contact point path corresponding to a constant curvature rocker arm pad. The input can further include adjustments to the contact point path 124 to obtain a modified contact point path. The modified contact path can be utilized to decrease the valve tip wear metric or the valve tick to desired levels, depending on the design objective.

The processor 424 can implement the techniques of the present disclosure. More specifically, the processor 424 can determine the custom contour for the rocker arm pad 116 and the custom contour for the camshaft lobe 204. This can include the processor 424 (i) calculating the valve tip wear metric as previously described herein and/or or (ii) calculating the smack energy for each side-wall (stem-to-guide) collision event as previously described herein. As previously mentioned, the processor 424 may calculate and display both metrics, and the user 404 can then provide the adjustment to the contact point path 124 to obtain a modified contact point path that satisfies his/her design objective (decreased valve tip wear or decreased valve tick), which is now described in greater detail.

The processor 424 can provide these calculated values to the interface 420 for display to the user 404. In some implementations, the processor 424 can also output an indication of the output value with respect to a corresponding threshold, e.g., the predetermined wear threshold and/or the predetermined smack energy threshold. The user 404 can then modify the contact point path 124 based on the output value, which is described in further detail below. For example, the user 404 may modify the contact point path 124 until the output value is less than its corresponding threshold. After modification, the modified contact point path can then be used to generate the custom contour for the rocker arm pad 116 and the custom contour for the camshaft lobe 204. In some implementations, the processor 424 may determine the modified contact point path that satisfies a design objective specified by the user 404 based on the received (or stored) parameters, and corresponding predetermined or received thresholds, without any additional input from the user 404, i.e., fully-automated. For example, the processor 424 may determine an optimal contact point path for the design objective.

In some implementations, the custom contour for the rocker arm pad 116 and the custom contour for the camshaft lobe 204 can be generated using separate software interfaces. It should be appreciated, however, that these custom contours can be generated using a single software interface. For example only, these custom contours may be tables of coordinates representing splines that can be used by the machining components 408 to fabricate the custom contoured components.

Figure 5:
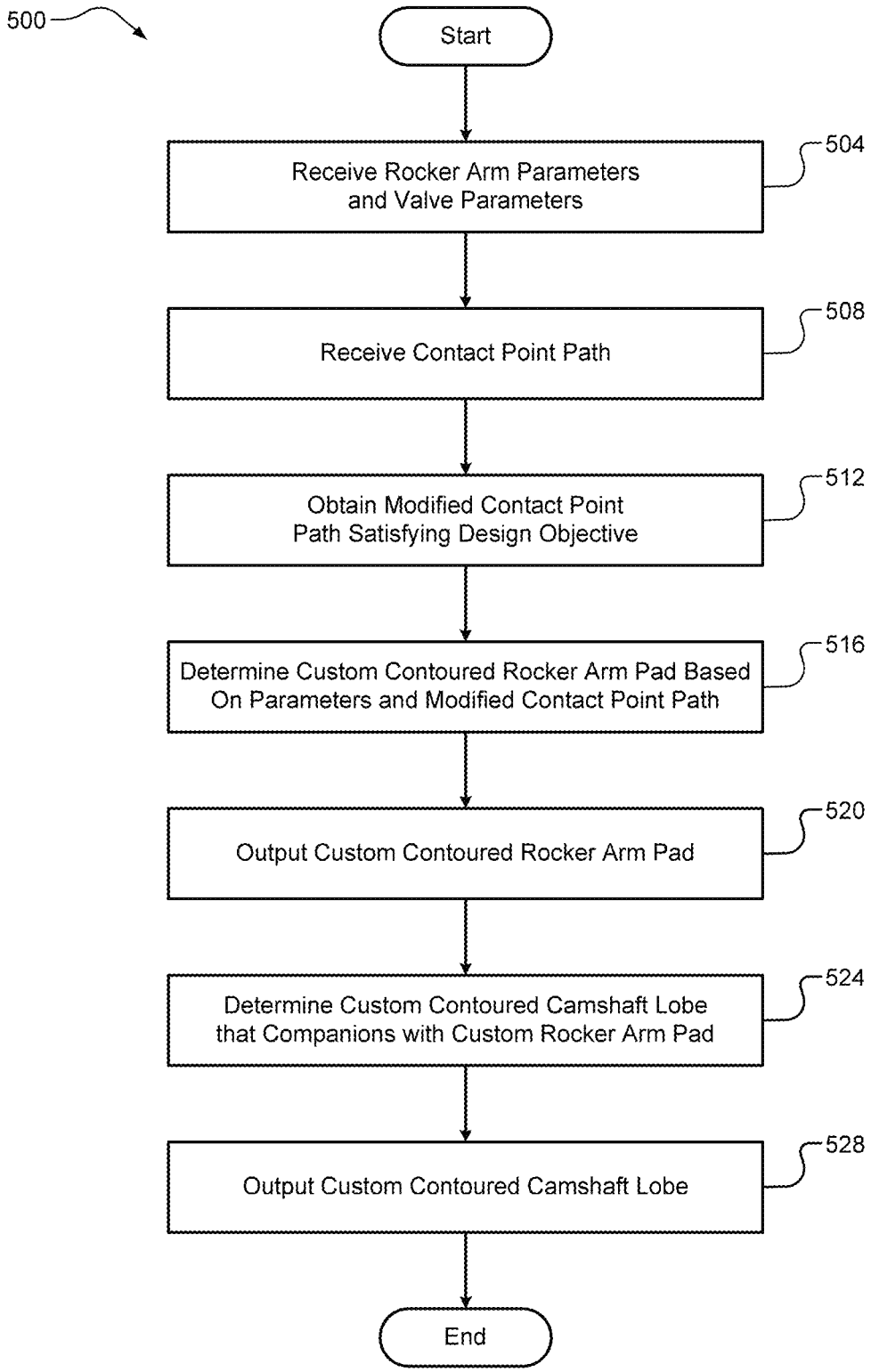
FIG. 5 is an example flow diagram of a method for designing a custom contoured rocker arm pad and a custom contoured camshaft lobe according to the principles of the present disclosure.

Referring now to FIG. 5, an example flow diagram of a method 500 for designing a custom contour for the rocker arm pad 116 and (optionally) a custom contour for the camshaft lobe 204 is illustrated. At 504, the computing device 400 can receive parameters for the rocker arm 108 and parameters for the valve 104. At 508, the computing device 400 can receive a contact point path. This contact point path can either be provided by the user 404 or can be a default, e.g., constant curvature, contact point path, which could be stored at and retrieved from memory 428. At 512, the computing device 400 can obtain a modified contact point path that satisfies a design objective. This modified contact point path can be obtained based on adjustments by the user 404 to the contact point path, or can be obtained automatically by the computing device 400. At 516, the computing device 400 can determine the custom contour for the rocker arm pad 116 based on the rocker arm parameters, the valve parameters, and the modified contact point path.

At 520, the computing device 400 can output the custom contour for the rocker arm pad 116. In some implementations, the computing device 400 may output the contact point path (or modified contact point path), which can be used to determine the custom contour for the camshaft lobe 204. At 524, the computing device 400 can determine the custom contour for the camshaft lobe 204 based on the specified contact point path. This can include determining the custom contour for the camshaft lobe 204 that companions with the custom contour for the rocker arm pad 116 to produce the specified contact point path. At 528, the computing device 400 can output the custom contour for the camshaft lobe 204 and, if not previously output, the custom contour for the rocker arm pad 116. The method 500 can then end or return to 504 for one or more additional cycles.

Figure 6A:
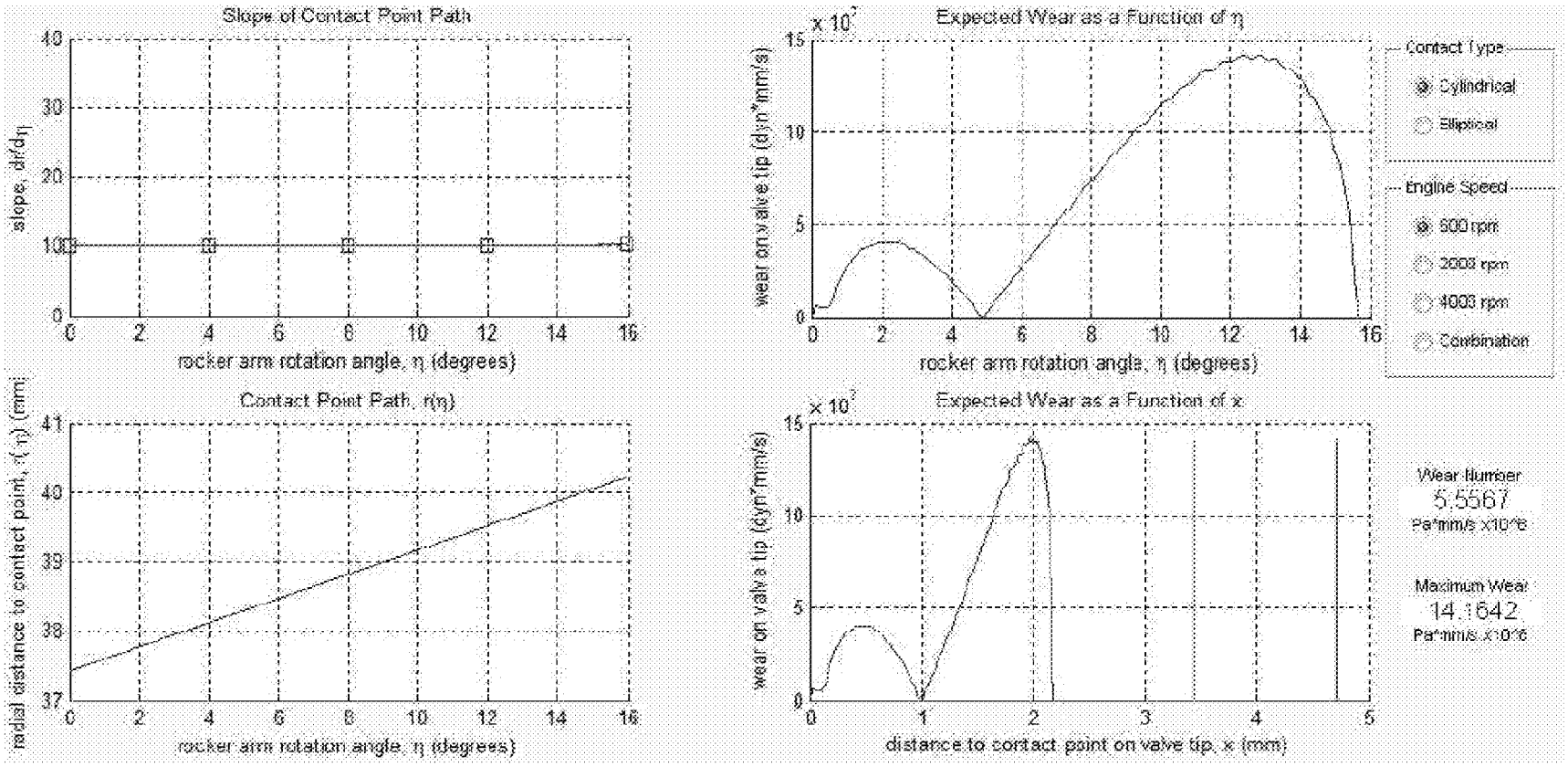
FIGS. 6A-6B are example user interfaces for designing a custom contoured rocker arm pads and custom contoured camshaft lobes for decreased valve tip wear according to the principles of the present disclosure.
Figure 6B:
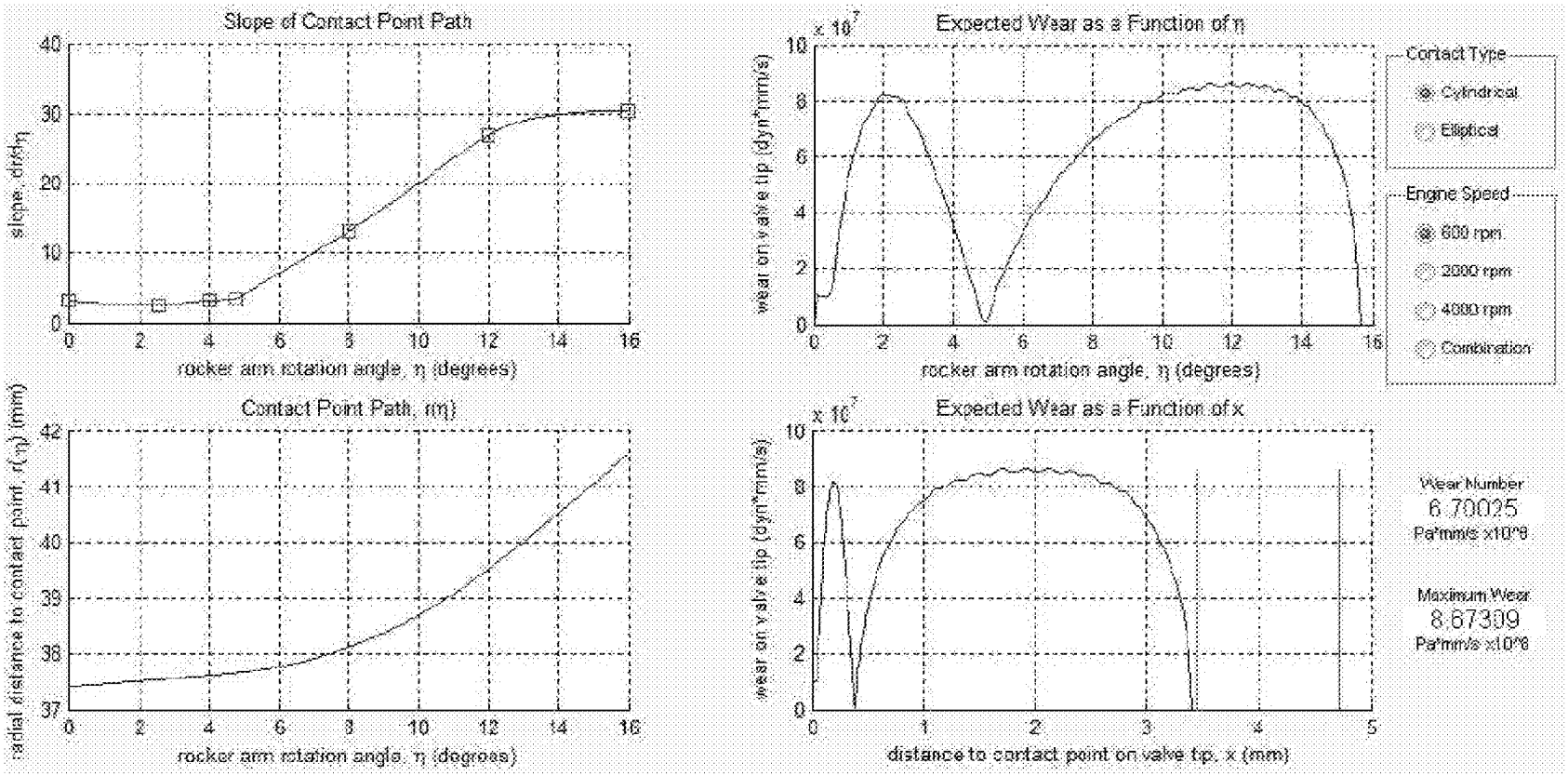

Referring now to FIGS. 6A-6B, first and second example user interfaces 600 and 650, respectively, are illustrated. The first and second example user interfaces 600 and 650 can be utilized for obtaining the custom contour for the rocker arm pad 116 for the design objective of decreased valve tip wear. It should be appreciated that the same or similar user interfaces can be utilized for obtaining the custom contour for the camshaft lobe 204.

In FIG. 6A, the first example user interface 600 illustrates the calculation and output of the valve tip wear metric for a default contact point path. The upper-left graph illustrates a slope ($dr/d\eta$) of the default contact point path. For example, the default contact point path can have a constant curvature. The bottom-left graph illustrates the default contact point path $r(\eta)$. The upper-right graph illustrates the valve tip wear metric. Each of these graphs (upper-left, lower-left, upper-right) displays information as a function of the rotation anglers of the rocker arm 108. The lower-right graph, on the other hand, illustrates the valve tip wear metric as a function of a distance (x) to the specific contact point on the valve tip 120. As shown, the majority of the valve tip wear occurs on one side of the valve tip 120, which can cause uneven valve tip wear.

In FIG. 6B, the second example user interface 650 illustrates the calculation and output of the valve tip wear metric for a modified contact point path, e.g., from the user 404. The upper-left graph illustrates a varying slope $dr/d\eta$ of the modified contact point path. The lower-left graph illustrates the modified contact point path $r(\eta)$. This modified contact point path defines a sharper curvature at rocker arm rotation angles $\eta$ corresponding to low engine load and a flatter curvature at rocker arm rotation angles $\eta$ corresponding to high engine load. The upper-right and lower-right graphs illustrate that the valve tip wear has been dispersed more evenly across the valve tip 120. In addition, the maximum valve tip wear metric has been decreased by almost 40%.

Figure 7A:
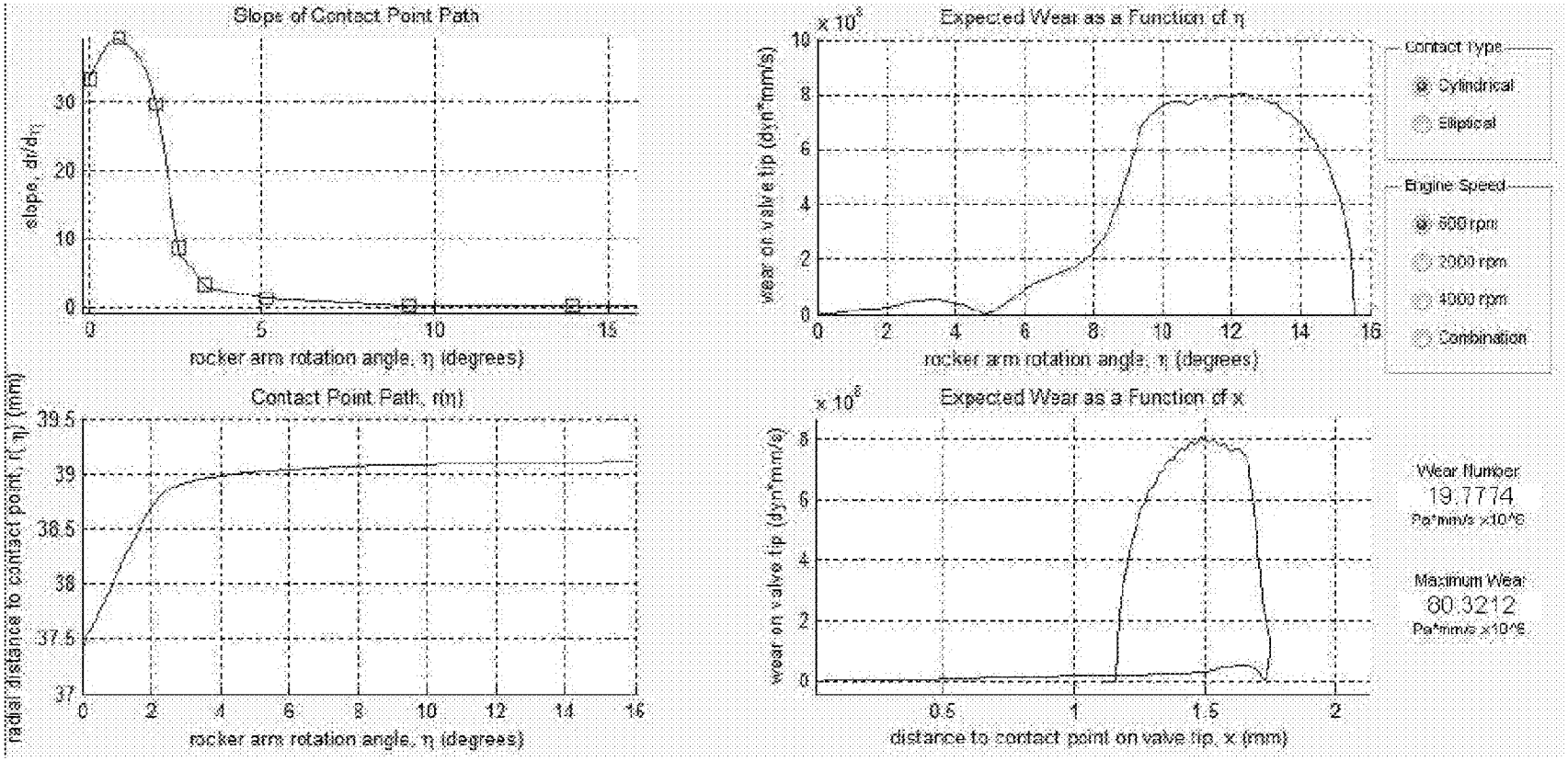
FIGS. 7A-7B are example user interfaces for designing a custom contoured rocker arm pad and custom contoured camshaft lobes for decreased valve tick according to the principles of the present disclosure.
Figure 7B:
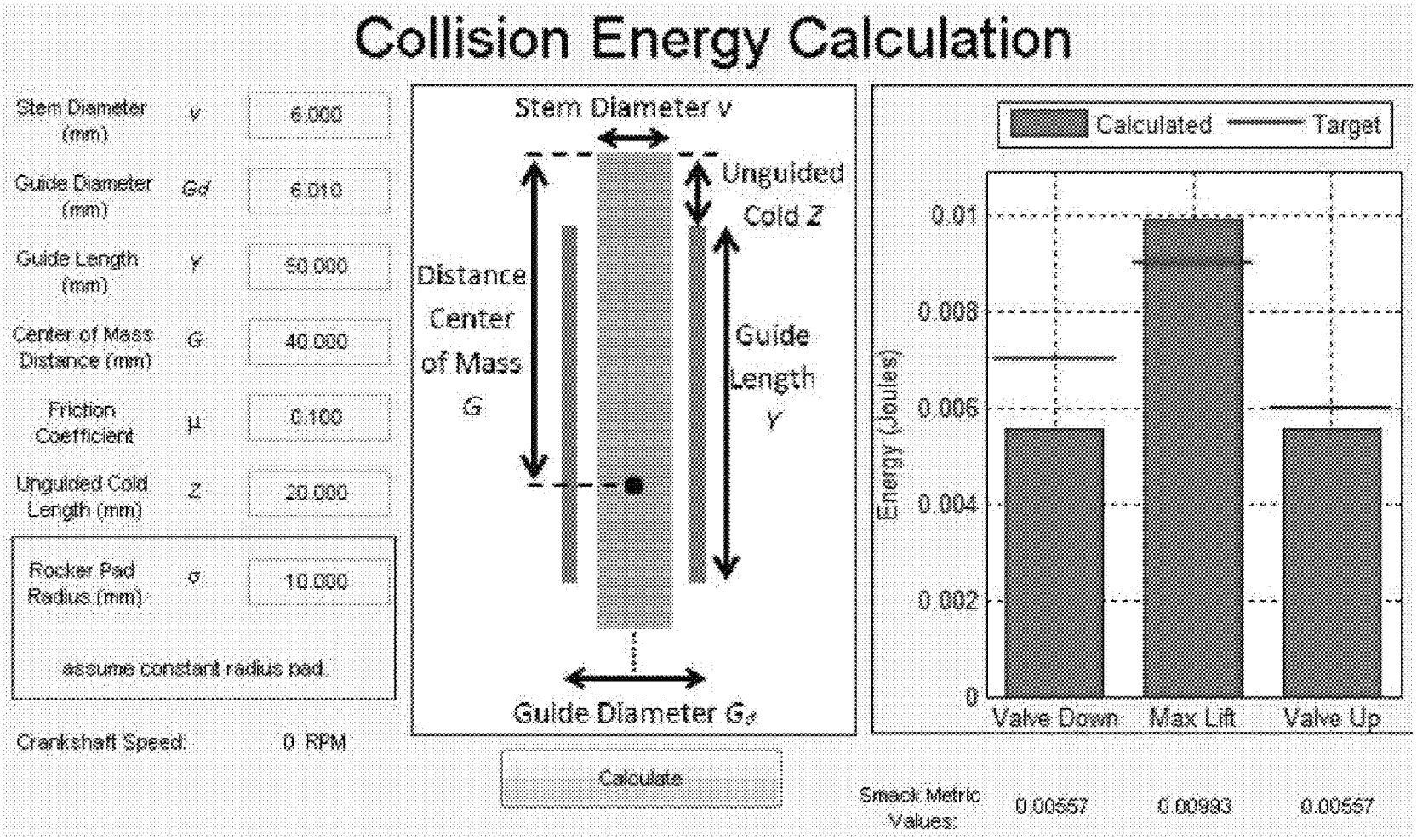

Referring now to FIGS. 7A-7B, third and fourth example user interfaces 700 and 750 are illustrated. The third and fourth example user interfaces 700 and 750 can be utilized for obtaining the custom contour for the rocker arm pad 116 for the design objective of decreased valve tick. It should be appreciated that the same or similar user interfaces can be utilized for obtaining the custom contour for the camshaft lobe 204.

In FIG. 7A, the third example user interface 700 illustrates the determination of a modified contact point path, e.g., from the user 404, for decreasing valve tick. The upper-left graph illustrates a varying slope $dr/d\eta$ of the modified contact point path. The lower-left graph illustrates the modified contact point path $r(\eta)$. This modified contact point path corresponds to an offset moment of the valve 104 that has an opposite sign to a friction moment of the valve 104. The upper-right and lower-right graphs illustrate valve tip wear, but these can be ignored because the design objective is decreased valve tick. FIG. 7B, on the other hand, illustrates a fourth example user interface 750 that can be used in conjunction with the third example user interface 700 to determine the modified contact point path that decreases the smack energy of the valve 104 to acceptable levels.

Specifically, in FIG. 7B the fourth example user interface 750 illustrates the calculation and output of the smack energy of the valve 104 for the modified contact point path shown in the third example user interface 700 of FIG. 7A. As shown, the smack energy can be calculated based on valve stem diameter (v), valve guide diameter ($G_d$), valve guide length (Y), a location of a center of mass of the valve 104 (and a distance (G) from the center of mass to the valve tip 120), an unguided cold length (Z) of the valve 104, and a friction coefficient ($\mu$) for assessing Coulomb friction between the valve tip 120 and the rocker arm pad 116. The smack energy (or smack metric) can also be based on the rocker arm pad radius $\sigma$, which may be assumed to be constant, i.e., a constant radius rocker arm pad. The target lines for the smack energy can represent the predetermined smack energy thresholds for the various valve lift positions (valve down, max lift, valve up).

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

The techniques described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

Some portions of the above description present the techniques described herein in terms of algorithms and symbolic representations of operations on information. These algorithmic descriptions and representations are the means used by those skilled in the data processing arts to most effectively convey the substance of their work to others skilled in the art. These operations, while described functionally or logically, are understood to be implemented by computer programs. Furthermore, it has also proven convenient at times to refer to these arrangements of operations as modules or by functional names, without loss of generality.

Unless specifically stated otherwise as apparent from the above discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system memories or registers or other such information storage, transmission or display devices.

Certain aspects of the described techniques include process steps and instructions described herein in the form of an algorithm. It should be noted that the described process steps and instructions could be embodied in software, firmware or hardware, and when embodied in software, could be downloaded to reside on and be operated from different platforms used by real time network operating systems.

The present disclosure also relates to an apparatus for performing the operations herein. This apparatus may be specially constructed for the required purposes, or it may comprise a general-purpose computer selectively activated or reconfigured by a computer program stored on a computer readable medium that can be accessed by the computer. Such a computer program may be stored in a tangible computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The algorithms and operations presented herein are not inherently related to any particular computer or other apparatus. Various general-purpose systems may also be used with programs in accordance with the teachings herein, or it may prove convenient to construct more specialized apparatuses to perform the required method steps. The required structure for a variety of these systems will be apparent to those of skill in the art, along with equivalent variations. In addition, the present disclosure is not described with reference to any particular programming language. It is appreciated that a variety of programming languages may be used to implement the teachings of the present disclosure as described herein, and any references to specific languages are provided for disclosure of enablement and best mode of the present invention.

The present disclosure is well suited to a wide variety of computer network systems over numerous topologies. Within this field, the configuration and management of large networks comprise storage devices and computers that are communicatively coupled to dissimilar computers and storage devices over a network, such as the Internet.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method, comprising:

receiving, at a computing device including one or more processors, parameters for a rocker arm and a valve of an engine and a contact point path defining a plurality of contact points between a pad of the rocker arm and a tip of the valve at various rotation angles of the rocker arm, the engine including a camshaft having a lobe operable to actuate the rocker arm via a follower or follower/pushrod, the valve having a stem and a guide;

calculating, at the computing device, one or more metrics based on the contact point path, the one or more metrics including at least one of (i) a valve tip wear metric and (ii) a stem-to-guide collision energy of the valve;

outputting, at the computing device, the one or more metrics;

receiving, at the computing device and based on the one or more metrics, an adjustment to the contact point path from a user to obtain a modified contact point path that satisfies a design objective of decreased valve tip wear or decreased valve tick, the modified contact point path causing at least one of the one or more metrics to decrease below a respective predetermined threshold;

determining, at the computing device, custom contours for the rocker arm pad and the camshaft lobe based on the modified contact point path;

based on the custom contours for the rocker arm pad and the camshaft lobe, generating, at the computing device, a set of instructions for machining a custom contoured rocker arm pad and a custom contoured camshaft lobe; and transmitting, from the computing device and to machining components via a network, the set of instructions, wherein receipt of the set of instructions is configured to cause the machining components to machine the custom contoured rocker arm pad and the custom contoured camshaft lobe.

2. The method of claim 1, wherein determining the custom contour for the rocker arm pad includes calculating, at the computing device, a curvature of the rocker arm pad at each point along the contact point path by calculating:

$$\kappa_2 = \frac{1}{\left(\frac{dr}{dn}\right)\cos(\eta - \alpha)},$$

where $\kappa_2$ represents the curvature of the rocker arm pad at a specific contact point, r represents a radial distance from a pivot point of the rocker arm to the specific contact point, $\eta$ represents an angular coordinate of the specific contact point, and $\alpha$ represents an initial angle between a plane of the valve tip and a plane connecting an initial contact point and the rocker arm pivot point.

3. The method of claim 1, wherein calculating the one or more metrics based on the contact point path includes calculating the valve tip wear metric, which includes:

calculating, at the computing device, a sliding velocity between the rocker arm pad and the valve tip at each contact point along the contact point path based on the rocker arm parameters and the valve parameters;

determining, at the computing device, a contact stress between the rocker arm pad and the valve tip at each contact point along the contact point path based on the rocker arm parameters; and calculating, at the computing device, the valve tip wear metric based on a product of the sliding velocities and the contact stresses.

4. The method of claim 3, wherein calculating the sliding velocity between the rocker arm pad and the valve tip at a specific contact point along the contact point path includes calculating:

$$\upsilon^{(12)}=r\omega\sin(\eta-\alpha)$$

where $\upsilon^{(12)}$ represents the sliding velocity, r represents a radial distance from a pivot point of the rocker arm to the specific contact point, $\eta$ represents an angular coordinate of the specific contact point, $\omega$ represents a change rate of change of $\eta$, and $\alpha$ represents an initial angle between a plane of the valve tip and a plane connecting an initial contact point and the rocker arm pivot point.

5. The method of claim 3, wherein determining the contact stress between the rocker arm pad and the valve tip at a specific contact point along the contact point path includes calculating, at the computing device, the contact stress based on an average contact pressure between the rocker arm pad and the valve tip for a single valve cycle, wherein the average contact pressure is based on a weighted average of a force applied by the rocker arm at a plurality of different engine loads.

6. The method of claim 1, wherein determining the custom contour for the rocker arm pad includes calculating, at the computing device, the stem-to-guide collision energy of the valve, wherein the stem-to-guide collision energy represents a kinetic energy imparted by the valve as it pivots about a bottom corner of its guide, and wherein the stem-to-guide collision energy is based on the rocker arm parameters, the valve parameters, and the contact point path.

7. The method of claim 6, wherein the modified contact point path decreases the stem-to-guide collision energy of the valve below an acceptable valve stem-to-guide collision energy threshold.

8. The method of claim 6, wherein the stem-to-guide collision energy is calculated based on valve stem diameter, valve guide diameter, valve guide length, a location of a center of mass of the valve, an unguided cold length of the valve, and a friction coefficient for assessing Coulomb friction between the valve tip and the rocker arm pad.

9. The method of claim 1, wherein the custom contour for the camshaft lobe companions with the custom contour for the rocker arm pad to produce the modified contact point path.

10. The method of claim 1, wherein calculating the custom contour for the camshaft lobe is further based on:

(i) a relationship $s(\phi)$ between an arc-length distance s along a surface of the rocker arm pad as measured from its zero-lift contact point with the valve tip and a rotation angle of the camshaft $\phi$, (ii) a first interpolating spline $\eta(\phi)$ that represents an angular velocity of the rocker arm as a function of the rotation angle of the camshaft $\phi$, where $\eta$ represents an angular coordinate of a specific contact point, (iii) a first derivative $d\eta/d\phi$ of the first interpolating spline $\eta(\phi)$ that represents an angular velocity of the rocker arm as a function of the rotation angle of the camshaft $\phi$, and (iv) a second derivative $d^2\eta/d^2\phi$ of the first interpolating spline $\eta(\phi)$ that represents the angular acceleration of the rocker arm, where $\phi$ represents a rotation angle of the camshaft.

11. The method of claim 10, wherein the relationship $s(\phi)$ is calculated by:

selecting, at the computing device, a number N of equally-spaced points over a range of $\phi$ where a camshaft lift profile $l(\phi)$ is non-zero;

determining, at the computing device, a value of s for each value of $\phi$ using the following zero-finding routine:

$$\min_{\varphi} l(\phi_i)+\Delta y_{max}-h_0-\min_{s} r(s_i)\cdot\sin(\tau(s_i))=0,$$

where i represents an index ranging from 1 to N, $\Delta y_{max}$ represents a y-coordinate of a contact point of the valve tip when the valve is at maximum lift, and $h_0$ represents the maximum lift displacement of the valve stem within its guide;

creating, at the computing device, a second interpolating spline that defines a function $s(\phi)s$, for i=1. . . N; and creating, at the computing device, the first interpolating spline $\eta(\phi)$ that defines $\eta$ as a function of $\phi$ from $(\phi_i, \eta(s(\phi_i))$.

12. The method of claim 11, further comprising calculating, at the computing device:

$$\Delta y_{max}=r_0\sin(-\alpha)+h_0,$$

where $r_0$ represents a radial distance from the a pivot point of the rocker arm to an initial contact point between the rocker arm pad and the valve tip, $\alpha$ represents an initial angle between a plane of the valve tip and a plane connecting the initial contact point and the rocker arm pivot point, and where $l(\phi)-h_0=0$ at maximum valve lift.

13. The method of claim 1, wherein the respective predetermined thresholds correspond to at least one of (i) increased valve life or more even valve tip wear and (ii) inaudible valve tick.

* * * * *